United States Patent [19]

Vitelli

[11] 3,940,967

[45] Mar. 2, 1976

[54] APPARATUS FOR CONTROLLED COOLING HOT ROLLED STEEL ROD IN DIRECT SEQUENCE WITH ROD MILL

[75] Inventor: Vito J. Vitelli, Shrewsbury, Mass.

[73] Assignee: Morgan Construction Company, Worcester, Mass.

[22] Filed: Jan. 10, 1975

[21] Appl. No.: 539,984

[52] U.S. Cl. ..... 72/201; 140/2; 266/2 A

[51] Int. Cl.[2] ..... B21B 45/02; B21B 43/00

[58] Field of Search ..... 148/12 B, 155, 156, 157; 72/39, 40, 200, 201, 202, 342, 364; 140/2; 266/2 R, 2 A, 2.5, 3 R

[56] References Cited

UNITED STATES PATENTS

| | | | |
|---|---|---|---|
| 3,390,871 | 7/1968 | McLean et al. | 140/2 X |
| 3,452,785 | 7/1969 | McLean et al. | 140/2 |
| 3,547,421 | 12/1970 | Hoffmann et al. | 140/2 X |
| 3,645,805 | 2/1972 | Hoffmann et al. | 148/156 |
| 3,711,918 | 1/1973 | Shore | 266/3 R |
| 3,718,024 | 2/1973 | Vitelli | 72/201 |
| 3,865,153 | 2/1975 | Vitelli | 140/2 |

*Primary Examiner*—Milton S. Mehr
*Assistant Examiner*—E. M. Combs

[57] ABSTRACT

Apparatus for conveying an elongated hot-rolled steel rod in overlapping off-set ring form over a controlled cooling conveyor. The conveyor is provided with a plurality of nozzles through which cooling air is supplied to the edges of the rings and with a lesser number of nozzles through which cooling air is supplied to the centers of the rings. The center and edge nozzles are supplied through independent air plenums each of which is supplied with air from independently controlled air blowers. The blowers are independently adjustable to adjust the quantity of cooling air to the center and edges of the rings. The nozzles are configured to direct high velocity streams of air along non-intersecting paths through the rings. The apparatus provides means for carrying out a process in which, by properly controlling the independently adjustable blowers, the rings may be made to cool along a predetermined time cooling curve with all parts of the rings cooling at the same rate.

5 Claims, 14 Drawing Figures

FIG. 5
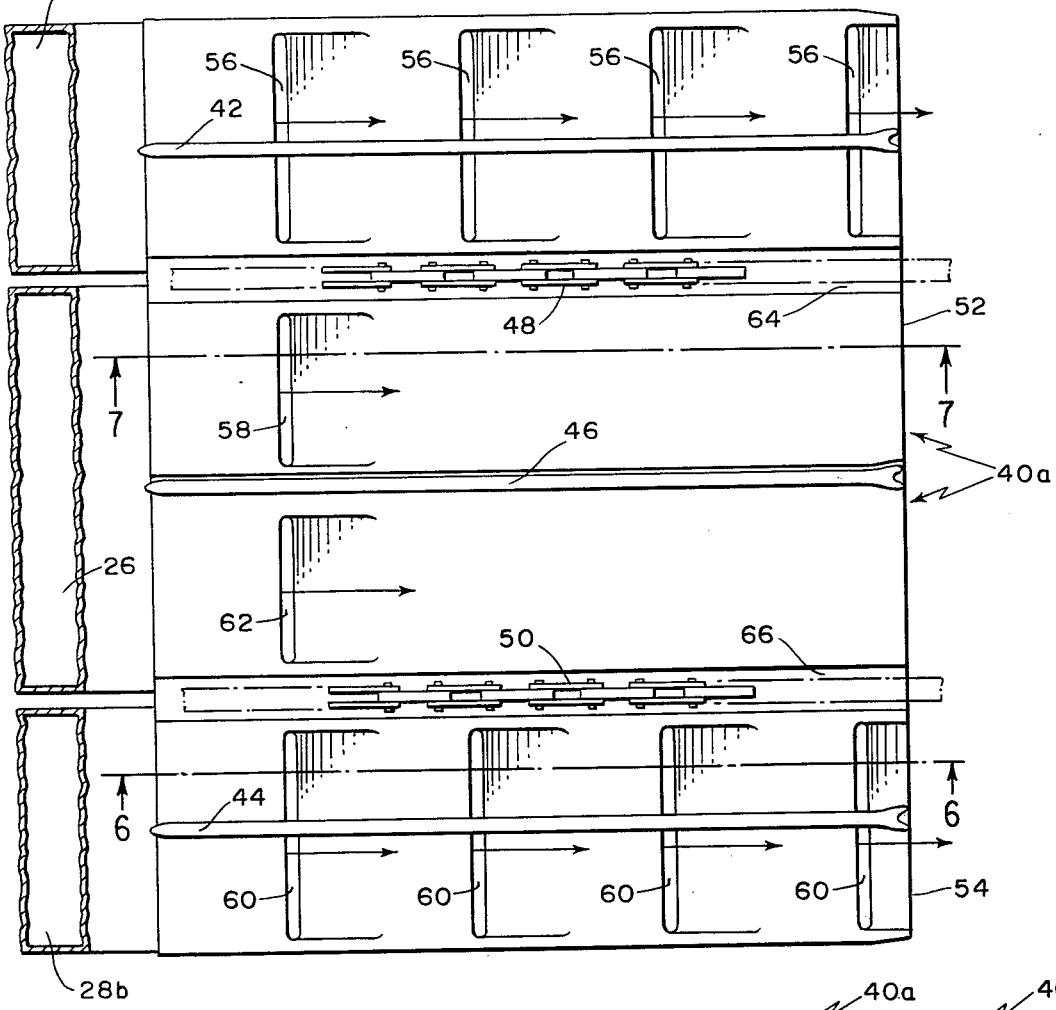
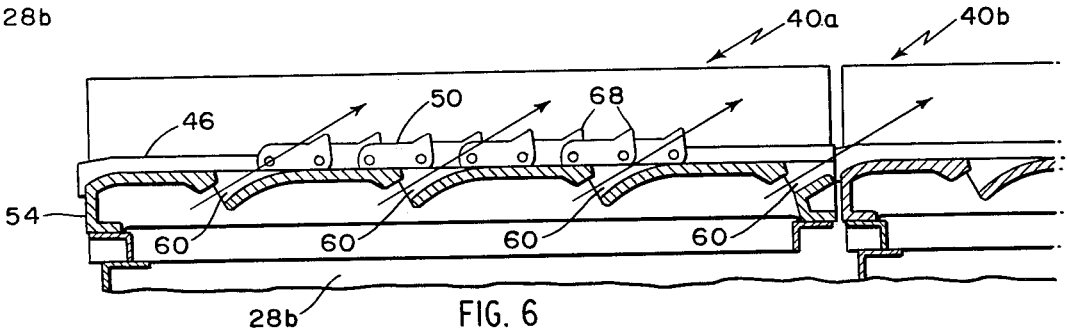
FIG. 6
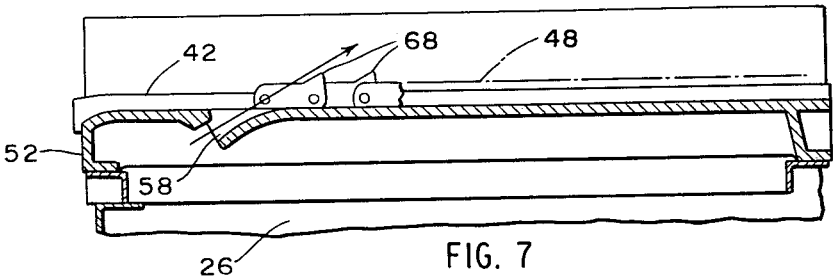
FIG. 7

APPARATUS FOR CONTROLLED COOLING HOT ROLLED STEEL ROD IN DIRECT SEQUENCE WITH ROD MILL

BACKGROUND OF THE INVENTION

The method of controlled cooling hot rolled steel rod by forced air cooling, known as the "Stelmor Process" is in successful extensive use throughout the world. It is described generally in the McLean et al U.S. Pat. No. 3,231,432 and involves direct coiling of hot rolled steel rod onto an open conveyor in spread-out rings and, as it is moved along the conveyor, rapidly cooling it by high velocity air streams delivered through nozzles from a plenum supplied with air from a high powered blower. It has been recognized that the quality of the rod produced by the Stelmor Process could, in some cases, be improved if one aspect of the process could be improved. This aspect which, despite much effort has eluded an adequate solution, arises from the tendency of the centers of the rings to cool at a rate which is approximately 25% faster than that of the edges of the rings. This effect is due, at least partly, to the heat shielding effect which the more closely spaced ring edges produce on each other.

One attempt at solving the problem has been to increase the relative areas of the edge and center nozzles so as to force a greater amount of air against the edges of the rings than against their centers. This method still exhibits a difference in the rod cooling rates between the edges and the centers. Another attempt has been to blow high velocity air across the rings from both sides as well as to flow air up through the centers of the rings. In this case, also, the desired degree of predetermined uniform cooling could not be reached.

THE INVENTION

This invention arises from the discovery that the prior attempts at a solution of the problem did not recognize an important principle upon which the present invention is based. This invention teaches that, in order to achieve the desired uniformity of cooling, at the rate at which the desired metallurgical properties of the rod are achieved, the streams of air delivered to the centers and the sides of the rings must be under independent control and must not affect or interfere with each other until the streams have passed beyond the areas in which their cooling effects are exerted. Thus, for example, increasing the areas of the edge nozzles with respect to the center nozzles produced such a reaction within the air plenum that the dynamic air pressure into the edge nozzles decreased, while the dynamic air pressure into the center nozzles increased. Therefore the necessary change in the relative cooling of the edges and center was not achieved. In the case of the separate streams of air coming in from the sides, such streams collided and interfered with each other directly in the area of the rings, which made it impossible to achieve the desired uniform cooling.

The present invention achieves the desired independence of air cooling by feeding the nozzles directed against the ring centers from a plenum which is independent of the plenum which feeds the edge nozzles. Each plenum is supplied with air from a separate air blower, each of which is separately controlled. The nozzles and the velocity of the air are so designed that the air streams are highly directional throughout their passages across and beyond the rings and furthermore are carefully oriented so that the directions of flow of the streams do not intersect at any location where such intersection could disturb the independence of the cooling air streams.

This invention will be more completely understood from the more detailed explanation below of the novel method and the novel apparatus for carrying out such method, both of which form the subject matter of this invention.

BRIEF DESCRIPTION OF THE DRAWINGS

In the drawings:

FIG. 5 is a top view, to a still larger scale, of one of the deck plate assemblies of the cooling zone illustrated in FIG. 4;

FIG. 6 is a cross section along line 6—6 of FIG. 5;

FIG. 7 is a cross section along line 7—7 of FIG. 5;

DESCRIPTION OF THE PREFERRED EMBODIMENT

Figure 2:
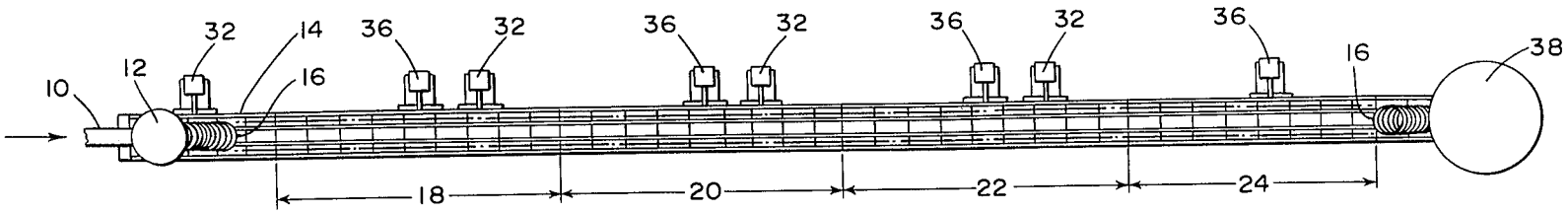
FIG. 2 is a top view of FIG. 1.
Figure 1:
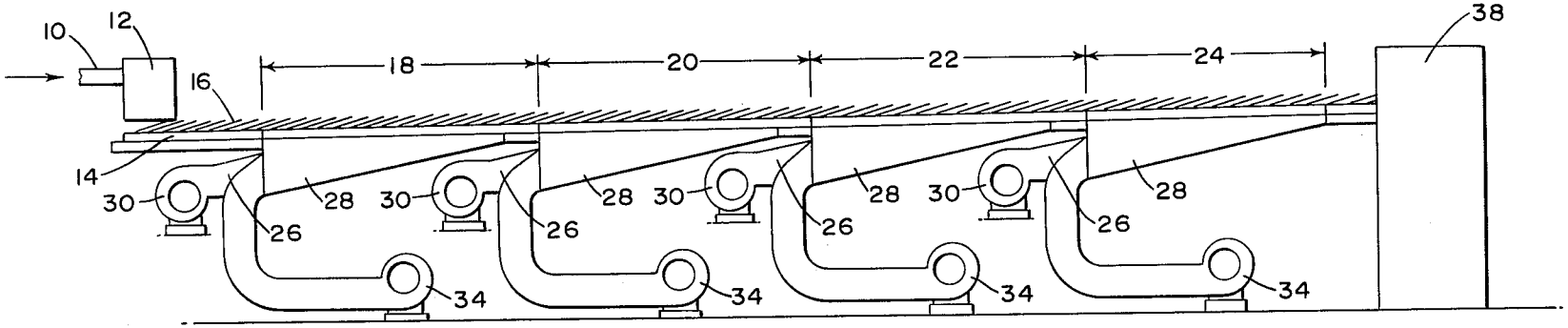
FIG. 1 is a diagrammatic illustration of a side view of an apparatus for cooling hot-rolled steel rod according to this invention.

In the exemplary embodiment of the present invention as illustrated in the drawings, FIGS. 1 and 2 show a continuous cooling apparatus for cooling hot rolled steel rod directly as it issues from the rod mill. The rolled rod issuing from the rod mill at the rolling temperature, for example about 1,850°F, is directed through a cooling and guide pipe 10 to a laying reel or cone 12. Water may be introduced into cooling pipe 10 to cool the rod to a suitable initial temperature from which it is cooled in the cooling apparatus. The magnitude of such initial temperature depends on the end product requirements, but is usually greater than 1,250°F. Laying cone 12 deposits the rod on a moving conveyor 14 in the form of a spread-out flat ring member 16 consisting of flat overlapping non-concentric rings. U.S. Pat. No. 3,231,432 describes one of several devices which may be used for the laying cone 12.

The apparatus moves the rod rings along a cooling conveyor divided into a plurality of cooling zones 18, 20, 22, 24 each of which is supplied with cooling air from a plurality of air plenums 26, 28. Cooling air from plenums 26 and 28 is directed against ring member 16, in a manner as will be described in detail below, so as to cool all portions of ring member 16 at the same predetermined rate to impart the desired properties to the finished rod. Each plenum 26 is supplied with air from a blower 30 driven by a motor 32 and each plenum 28 is supplied with air from another blower 34 driven by a motor 36.

After the rings 16 have moved through each of the cooling zones they pass into a ring collecting device 38.

The details of this device are not shown since there are several suitable devices for this purpose, for example, such as that described in U.S. Pat. No. 3,231,432.

Figure 4:
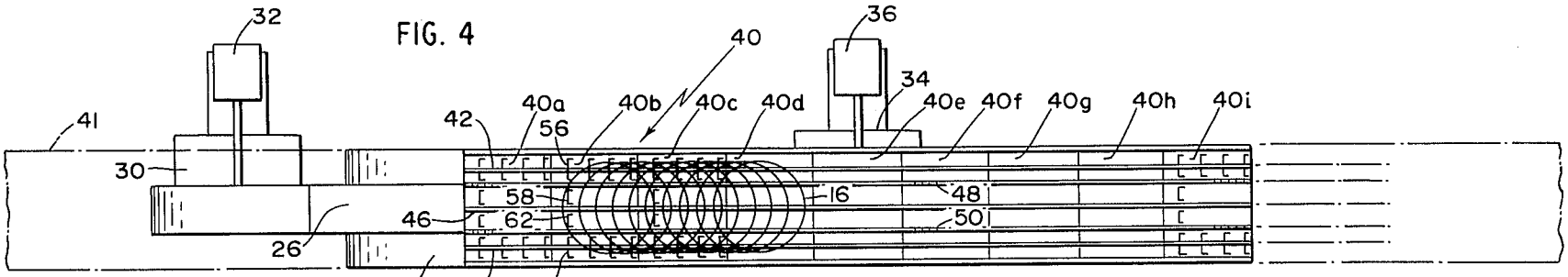
FIG. 4 is a top view of FIG. 3.
Figure 3:
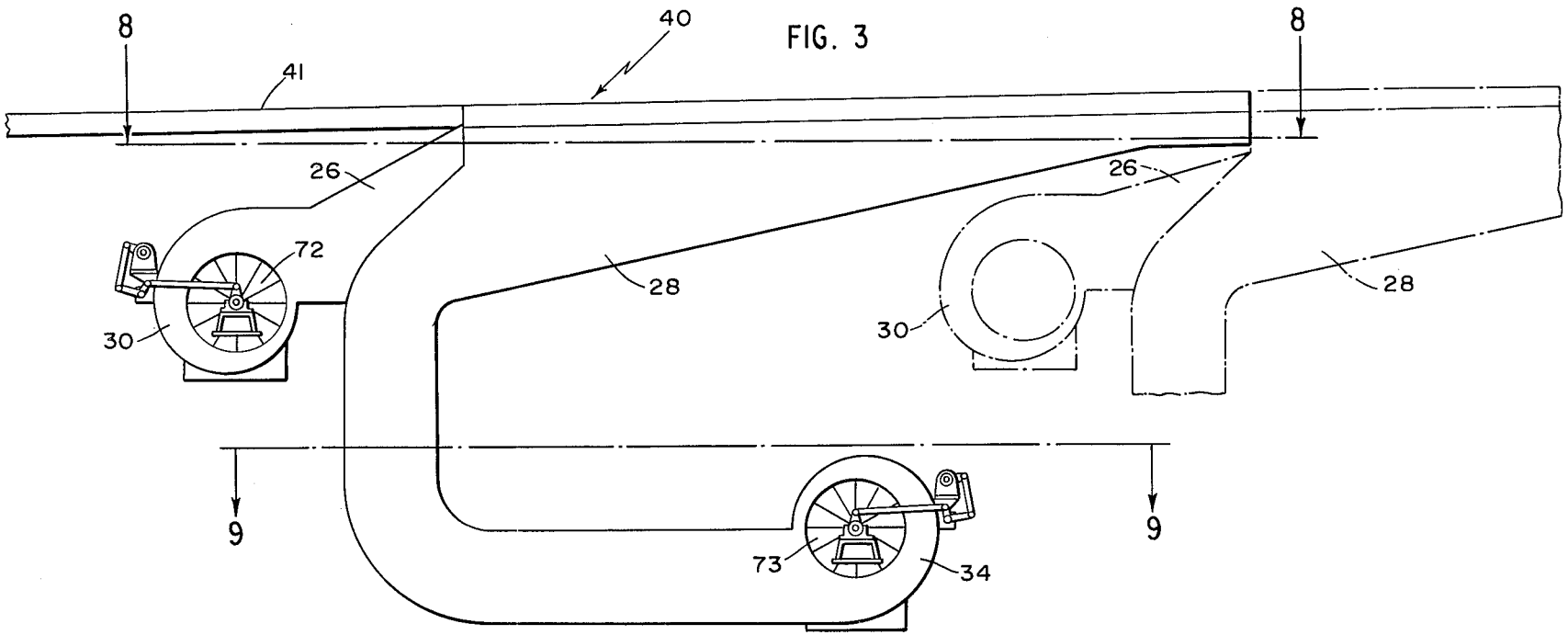
FIG. 3 is a side view, to a larger scale, of one of the cooling zones of FIG. 1.

Some of the details of a cooling zone, (e.g. zone 18) are shown more clearly in FIGS. 3 and 4. In these FIGS., the deck upon which the rings 16 move is designated generally at 40. That portion of the deck, shown at 41, leading from the layer cone to the first cooling zone, is shown in dotted lines in FIG. 4 so as to show the underlying air plenum structure. Mounted on deck 40 are a pair of edge skid rails 42 and 44 along which the edge portions of the rings 16 ride and a center skid rail 46 along which the central portions of the rings 16 ride. The rings 16 are conveyed along the cooling zone by a pair of chain drives 48 and 50. The deck 40 of each cooling zone is comprised of a plurality of cast iron deck plates 40*a*–40*i*, typically nine in number.

FIGS. 5, 6, and 7 show the details of a typical deck plate 40*a* and its associated structures. Deck plate 40*a* is made of two halves 52 and 54. Member 52 is provided with a plurality of edge air nozzles 56, typically three in number, and with a single center air nozzle 58. Similarly member 54 is provided with edge air nozzles 60 and a single center air nozzle 62. The edge skid rail 42 is mounted above the edge air nozzles 56, the opposite edge skid rail 44 is mounted above the edge air nozzles 60, and the center skid rail 46 is mounted along the center line between the two members 52 and 54. The member 52 is provided with a groove 64 along which the chain drive 48 travels while member 54 is provided with a groove 66 along which chain drive 50 travels. The links of the chain drives 48 and 50 are provided with sprocket members 68 which engage the rings 16 and drive them along the conveyor 14. Only a few links of chain drives 48 and 50 are illustrated, it being understood that these chain drives extend throughout the length of the apparatus and are actuated by suitable driving mechanisms, not shown, in order to impart the desired speed of travel of the rings 16 through the apparatus.

As indicated diagrammatically in FIG. 4, the edge portions of the rings 16 overlie the edge nozzles 56 and 60, while the central portions of the rings 16 overlie the center nozzles 58 and 62. As shown in FIGS. 5, 6, and 7, the edge nozzles 56 and 60 are supplied with cooling air from air plenums 28*a* and 28*b*, which are branches of the plenum 28 as will be explained below. The center nozzles 58 and 62 are supplied with cooling air from the plenum 26. Each of the nozzles 56, 58, 60 and 62 is configured so as to produce a highly directional stream of air (indicated by the arrows in FIGS. 5–7) which is inclined by a suitable angle (e.g. 30° above the horizontal) along the direction of travel of the rings 16. Furthermore the axes of the jets are so oriented that none of them intersect any other, and none of the streams of air are intercepted by any other stream until they have passed well outside of the space in which the rings 16 are located. Such paths for the air streams will be referred to as non-intersecting paths.

As shown in FIG. 6, the first deck plate 40*a* abuts the succeeding deck plate 40*b* to form the continuous deck 40. It is to be understood that the successive deck plates are likewise arranged to complete the deck 40 as shown in FIG. 4.

Figure 8:
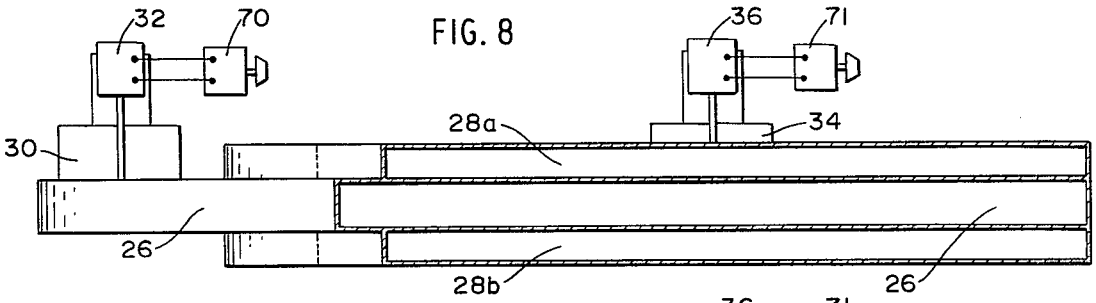
FIG. 8 is a cross section along line 8—8 of FIG. 3.
Figure 9:
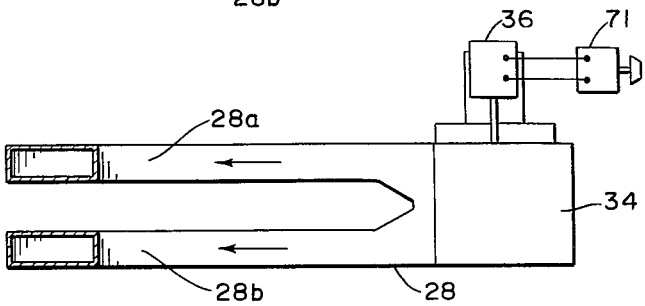
FIG. 9 is a cross section along line 9—9 of FIG. 3.

The arrangement whereby the air plenums are supplied with air is shown diagrammatically in FIGS. 8 and 9. Blower 30 feeds directly into the center air plenum 26. Blower 34 feeds into the plenum 28 which divides into two branches 28*a* and 28*b* which comprise the edge plenums for feeding the edge nozzles.

Each of the motors 32 and 36 may be supplied with a speed control device 70 and 71 respectively (shown diagrammatically in FIGS. 8 and 9) while the quantity of air supplied by each blower 30 and 34 is under the control of the operator by means of controllable louver mechanisms 72 and 73 respectively, shown diagrammatically in FIG. 3. Since the details of such controllable louvres are well known, the details of such mechanisms are not shown.

Figure 10:
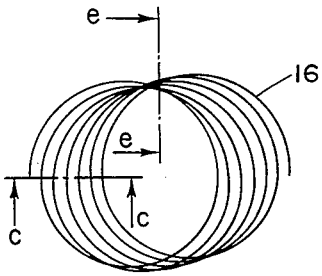
FIG. 10 is a diagrammatic showing of a portion of the rod rings being processed.
Figure 10E:
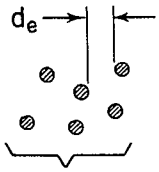
FIG. 10*e* is a cross section along line *e—e* of FIG. 10.
Figure 10C:
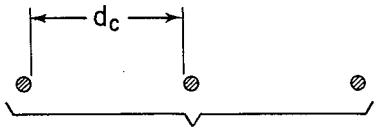
FIG. 10*c* is a cross section along line *c—c* of FIG. 10.

The phenomena involved in the cooling of rings 16 may be better understood with reference to FIGS. 10, 10*e*, and 10*c*. FIG. 10 is a diagrammatic showing of a few of the rings of ring member 16. As will be seen, the edges of the rings do not lie in regular order upon each other, but are dispersed with a varying degree of lateral dispersion. Thus, when an edge section is taken along line *e*—*e* the result is shown in FIG. 10*e*. For example, in the case of .218 inch diameter rod arranged in 40 inch diameter rings spread out about 2 inches, the cross section 10*c* would be about 1 inch high and 2 to 3 inches wide, containing about five to seven rod cross sections. The average spacing $d_e$ between the ring edges would be about one-fourth inch. The center cross section 10*c* would show the ring centers with an average spacing $d_c$ of about 2 inches. The tendency of the ring edges to cool more slowly than the centers is due, at least in part, to the mutual heat shielding which the ring edges, as shown in FIG. 10*c*, exert upon each other as compared with the lack of such heat shielding of the centers, as shown in FIG. 10*c*. In addition the edge ring pattern presents a higher impedance to the flow of cooling air around each rod cross section than such impedance at the ring centers. As already stated, previous attempts at equalizing the cooling of the ring edges and centers by directing a greater amount of cooling air at the edges than at the centers have not been able to achieve the desired results.

The desired results of the cooling process are, not only to cause the centers and edges of the rings to cool at the same rate in order to achieve uniformity in the properties of the rod, but also the profile of the rate of cooling along the cooling conveyor must be maintained along a predetermined curve so that the desired properties of the rod are obtained. This may be more clearly understood with reference to FIG. 11 in which the temperature of the rod is plotted along the vertical axis and the position of the rod along the cooling conveyor is plotted along the horizontal axis. Rod entering the cooling conveyor at an initial temperature *i* may cool along a desired solid curve *e*. At a critical temperature $T_t$ the crystal grains of the steel undergo transformation. This is exothermic so that the cooling curve *e* will exhibit a slight rise *r* at such point. Beyond *r*, the curve *e* continues with a lower slope than before point *r*. The curve *e* might represent a cooling curve for the edges of the coils 16. However, the tendency of the centers of the rings to cool faster than the edges might cause the temperature of the centers to follow the dotted curve *c*. In that case the properties of the rod at the centers of the rings would be different from the properties of the rings at their edges, particularly since the transition temperature $T_t$ would occur at a different time as indicated by the rise $r'$ on curve *c*.

Figure 12:
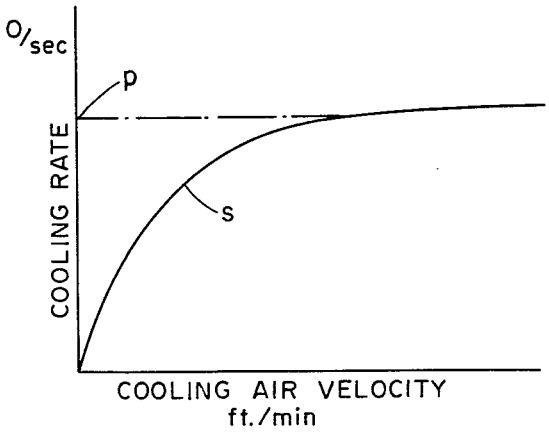
FIG. 12 is a graph showing the relation between velocity of cooling air and cooling rate of the rod rings.

The problem of causing curve *c* to coincide with curve *e* without changing curve *e* itself, is one which heretofore has eluded a satisfactory solution. Part of the difficulty in arriving at such a solution has been due to the fact that when an attempt is made to change the quantity of air per unit time supplied to a hot rolled rod from any given nozzle, the change in cooling rate does not follow the change in such quantity. In FIG. 12, the rate at which a hot rod cools is plotted along the vertical axis in degrees per second and the velocity of cooling air supplied to the rod is plotted along the horizontal axis in feet per minute. As will be seen the resultant curve s initially rises rapidly and flattens out until at point *p*, further increase in air velocity does not produce any substantial increase in the cooling rate.

Figure 11:
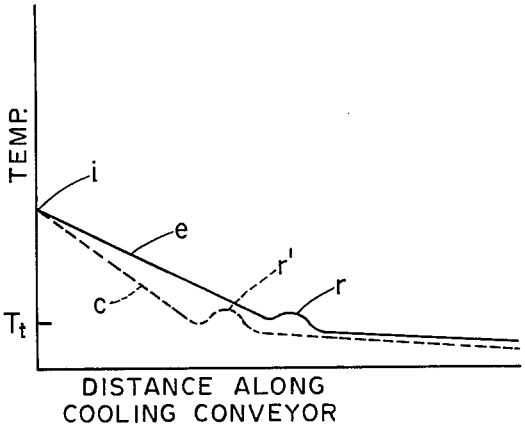
FIG. 11 is a cooling graph showing temperature of the rod rings along the apparatus.

In the present invention, due to the complete independence of the flow of air to the edges from the flow of air to the center of the rings, the desired objective is readily attained. A typical operation of the apparatus would be as follows. The initial temperature at which the rod is deposited on the conveyor is predetermined at the cooling and guide pipe 10 as described. The desired cooling rate curve, as shown in FIG. 11, is computed to impart the desired properties to the particular rod being processed. The point along the conveyor at which the discontinuity *r* should occur is determined from the cooling rate curve. Each motor 36 and blower 34 is adjusted by its controls to supply cooling air through edge nozzles 56 and 60 at a rate which, from experience, is expected to cool the edges of the rings along the desired cooling curve. Likewise each motor 32 and blower 30 is adjusted to run at approximately the expected rate. In recognition of the limitation on the effective velocity of cooling air as illustrated by FIG. 12, the edge nozzles are designed to be sufficiently large in number and nozzle area to supply an adequate quantity of cooling air to the edges within such limitation. In order to cool the rod at the maximum desired cooling rate, the velocity of the cooling air comprising on the ring edges is usually selected close to the maximum useful velocity. As will be pointed out, the quantity of air to be supplied to the centers of the rings will be substantially less than that supplied to the edges. Therefore, in the embodiment illustrated, the total nozzle area for the edge nozzles in each deck plate is designed to be about five times the total nozzle area of the center nozzles.

In practice hot rolled rod is run through the apparatus and temperature measurements are taken along the conveyor. These measurements may be made by any suitable type of temperature measuring device, such as a radiation pyrometer, although a skilled operator could qualitatively determine the temperatures visually from the redness of the rings along the conveyor. Each adjustable louvre 73 on the edge blower 34 has been positioned to obtain the appropriate quantity of air to achieve the desired cooling rate profile along the conveyor. The temperature measurements and observations along the conveyor at the edges and centers of the rings are taken simultaneously. Inevitably there will be some difference in the cooling rates, usually with the centers cooling faster than the edges. Thereupon the operator resets the adjustable louvre 72 on each blower 30, usually by decreasing the quantity of air being delivered to the center of the conveyor by the blower 30, until the desired cooling rate coincidence is achieved.

In actual practice the time needed to achieve the desired coincidence is quite short. Thereafter the entire length of rod to be processed is run through the apparatus under the monitoring control of the operator who may make minor adjustments in the amount of air, usually to the center nozzles, to maintain the desired cooling rate coincidence. If desired such monitoring could be made automatic by using automatic temperature measuring devices for the centers and edges of the rings. The outputs of such devices would be compared and any difference would be used to actuate an automatic control on the controllable louvres 72 to maintain the proper cooling rate coincidence. Since automatic control systems of such kind are readily available to persons skilled in this art, the details of such a system are not given herein. In actual operation a minimum of such continuing monitoring will be required.

It is to be understood that modifications in the method steps as well as in the apparatus may be made within the scope of the invention as defined in the claims. For example instead of first fixing the cooling rate of the ring edges, the cooling at the center of the rings might be set and then the edge cooling adjusted to coincidence. Also the complete independence of the air supplies for the center and edge nozzles permits other conditions of the air to be used. For example, the air in the center and edge plenum might be at different temperatures by the preheating or precooling of the air in one of the plenums as compared with the air in the other of said plenums. While air is the usual cooling medium used, other suitable mediums such as steam, inert gases, or chemically active gases selected purposely to beneficially affect or alter the oxide scale present on the rod by means of a reduction or oxidation reaction, or other chemical reaction could be used. Therefore, the given term "gas" will be used to include air and all other suitable gaseous cooling mediums. Other fluid mediums might also be employed. The important aspect is that the cooling of the rod rings at the edges and centers of the conveyor can be independently adjustable and non-interfering with one another.

Various other modifications will suggest themselves to those skilled in the art.

I claim:

1. An apparatus for treating hot steel rod comprising:

a. an elongated cooling conveyor;

b. a conveyor adapted to receive hot steel rod in the form of spread-out rings and for moving said rings along said cooling conveyor;

c. said cooling conveyor being provided with a plurality of edge nozzles disposed adjacent the path traversed by the edges of said rings, and with a plurality of center nozzles disposed adjacent the path traversed by the centers of said rings;

d. first blowing means for supplying cooling gas to said edge nozzles for producing ring edge cooling gas streams, and second blowing means for supplying cooling air to said center nozzles for producing ring center cooling gas streams, said first and second blowing means being independent of each other;

e. said nozzles being oriented to produce gas streams along nonintersecting paths.

2. Apparatus as in claim 1 in which said first blowing and second blowing means are adjustable independent of each other to adjust the quantity of gas supplied to said center and edge nozzles.

3. Apparatus as in claim 1 in which said first blowing means is connected to said edge nozzle through a first gas plenum, and said second blowing means is connected to said center nozzles through a second gas plenum, the interiors of said first and second plenums being isolated from each other.

4. Apparatus as in claim 1 in which the aggregate cross-sectional area of the gas passages of said edge nozzles is substantially greater than the aggregate cross-sectional area of the gas passages of said center nozzles.

5. Apparatus as in claim 1 in which said aggregate cross-sectional area of said edge nozzles is on the order of five times said aggregate cross-section area of said center nozzles.

* * * * *